US005171435A

United States Patent [19]

Nishimura et al.

[11] Patent Number: 5,171,435

[45] Date of Patent: Dec. 15, 1992

[54] DEHYDRATOR TUB FOR CLOTHES WASHING WITH CONTROLLED VARIABLE ROTATIONAL SPEEDS

[75] Inventors: Hiroshi Nishimura, Seto; Daisuke Naka, Kasugai, both of Japan

[73] Assignee: Kabushiki Kaisha Toshiba, Kanagawa, Japan

[21] Appl. No.: 750,531

[22] Filed: Aug. 27, 1991

[30] Foreign Application Priority Data

Aug. 27, 1990 [JP] Japan ..... 2-226072

[51] Int. Cl.[5] ..... D06F 33/00; D06F 33/02

[52] U.S. Cl. ..... 210/138; 34/52; 34/53; 68/12.14; 68/23.1; 210/145; 210/360.1

[58] Field of Search ..... 68/12.14, 23 R, 23.1; 34/52, 53; 210/130, 144, 145, 368, 360.1

[56] References Cited

U.S. PATENT DOCUMENTS 3,365,810 1/1968 Kotyuk et al. ..... 34/52
3,546,786 12/1970 Jacobs ..... 34/52
4,841,207 6/1989 Cheyne ..... 318/139

FOREIGN PATENT DOCUMENTS 63-29694 2/1988 Japan ..... 68/23.1
1314599 12/1989 Japan ..... 68/12.14
2-80089 3/1990 Japan ..... 68/23.1

*Primary Examiner*—Mary L. Theisen
*Assistant Examiner*—Joseph Drodge
*Attorney, Agent, or Firm*—Philip M. Shaw, Jr.

[57] ABSTRACT

A dehydrator for use in washing clothes or the like includes a dehydration tub mounted in an outer cabinet, a brushless motor for rotating the dehydration tub for a dehydrating operation, and a microcomputer-based controller for controlling the rotational speed of the motor so that the motor is rotated at a plurality of different rotational speeds sequentially during the dehydrating operation. The different rotational speeds include a maximum rotational speed ranging between a rated rotational speed or above and a rotational speed corresponding to a resonant point of the outer cabinet.

7 Claims, 5 Drawing Sheets

DEHYDRATOR TUB FOR CLOTHES WASHING WITH CONTROLLED VARIABLE ROTATIONAL SPEEDS

BACKGROUND OF THE INVENTION

This invention relates to a dehydrator including a dehydration tub rotated at a high speed by a motor for dehydrating clothes contained therein.

In fully automatic washing machines, for example, a rotatable tub serving both as a wash tub and a dehydration tub is rotated for dehydrating clothes to be washed. An induction motor has been generally employed for driving the rotatable tub in the conventional fully automatic washing machines. The rotational speed of the induction motor cannot be freely varied and accordingly, is substantially invariable. Consequently, the rotational speed is rapidly increased to a value determined depending upon the number of poles when the induction motor is energized.

Upon start of the dehydrating operation, the rotational speed of the rotatable tub is rapidly increased, reaching its maximum value. The maximum rotational speed of the rotatable tub is usually set at 850 r.p.m. which value is also a rated rotational speed. Since this rotational speed is low for the dehydrating operation, a dehydrating period of time is increased in compensation for the low rated speed so that the dehydration efficiency is increased.

Upon start of the dehydrating operation, a large amount of water contained in clothes is shaken off and discharged out of the rotatable tub. Since the rotational speed of the rotatable tub is rapidly increased to the maximum speed in the prior art, a large amount of water is discharged from the rotatable tub and a force of the discharged water is suddenly intensified particularly at an initial stage of the dehydrating operation. Consequently, the discharged water collides with a great force with the inner peripheral wall of a water-receiving tub in which the rotatable tub is enclosed, producing a loud noise.

On the other hand, the dehydration efficiency is not increased above a certain value at the maximum rotational speed in the prior art even when the dehydrating period of time is increased. To solve this problem, it is proposed that the rotational speed of the rotatable tub be increased above the rated rotational speed. In this case, however, the rotational speed of the rotatable tub agrees with a resonant point of the outer cabinet of the washing machine, resulting in a loud vibrational noise produced from the outer cabinet. Alternatively, the rotational speed of the rotatable tub passes the resonant point of the outer cabinet in the process that it is increased, also resulting in a loud vibrational noise produced from the outer cabinet.

SUMMARY OF THE INVENTION

Therefore, an object of the present invention is to provide a dehydrator in which production of a loud noise can be prevented during the operation.

In accordance with the present invention, a dehydrator comprises a dehydration tub mounted in an outer cabinet, and control means for controlling the rotational speed of the motor so that the motor is rotated at a plurality of different rotational speeds sequentially during the dehydrating operation, the different rotational speeds including a maximum rotational speed ranging above a rated rotational speed and below a rotational speed corresponding to a resonant point of the outer cabinet.

The dehydration efficiency can be increased since the maximum rotational speed of the dehydration tub is higher than the rated rotational speed. Further, the outer cabinet can be prevented from resonating since the maximum rotational speed of the dehydration tub is lower than the resonant point of the outer cabinet, resulting in prevention of noise.

It is preferable that the dehydration tub be held at the rated rotational speed for a predetermined period of time and subsequently, the dehydration tub be rotated at the maximum rotational speed for a period of time shorter than the period of time during which the dehydration tub is held at the rated rotational speed.

The dehydration tub is rotated at the predetermined low speed for the predetermined period of time at the initial stage of the dehydrating operation. A large amount of water contained in the clothes is shaken off during the low speed rotation period. Additionally, since the force of the discharged water is not relatively large, a loud noise can be prevented from being produced from the outer cabinet.

Other objects of the present invention will become obvious upon understanding of the illustrative embodiments about to be described and will be indicated in appended claims. Various advantages not referred to herein will occur to one skilled in the art upon employment of the invention in practice.

BRIEF DESCRIPTION OF THE DRAWINGS

The embodiment of the invention will be described merely by way of example with reference to the accompanying drawings in which.

DESCRIPTION OF THE PREFERRED EMBODIMENTS

An embodiment of the invention will be described wherein the invention is applied to a fully automatic washing machine.

Figure 1:
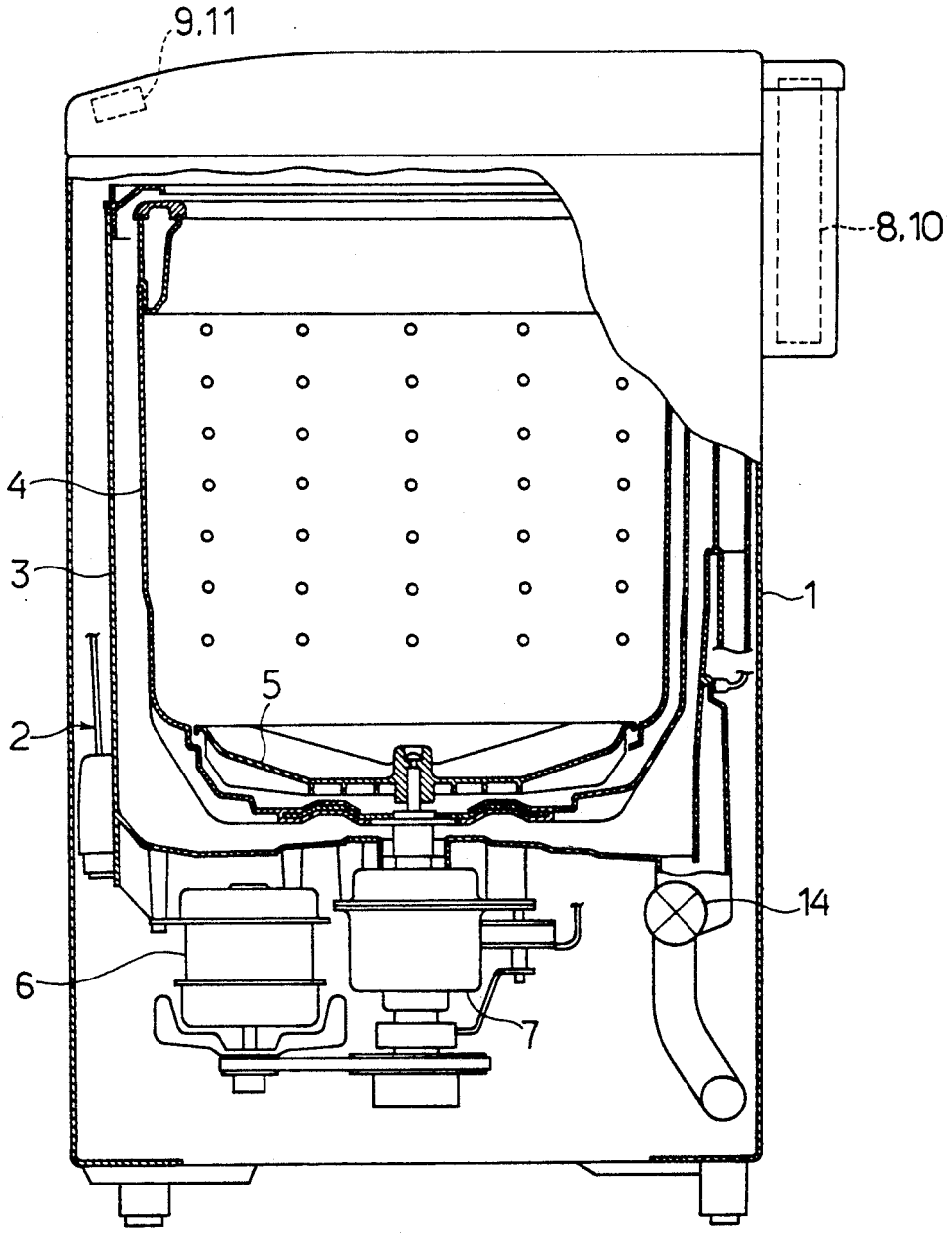
FIG. 1 is a longitudinal sectional view of a fully automatic washing machine incorporating a dehydrator in accordance with the present invention.

Referring to FIG. 1 of the accompanying drawings, a water-receiving tub 3 is held by an elastic suspension mechanism 2 in an outer cabinet 1 of the fully automatic washing machine. A rotatable tub 4 serving both as a wash tub and a dehydration tub is rotatably mounted in the water-receiving tub 3. A receptacle-like agitator 5 is rotatably mounted in the rotatable tub 4. A three-phase dc brushless motor 6 is mounted on the underside of the water-receiving tub 3. The rotational speed of the brushless motor 6 is variable depending upon the magnitude of a dc voltage applied to it. A mechanical section 7 including a reduction gear mechanism is also provided on the underside of the water-receiving tub 3. Rotation of the motor 6 is reduced and transferred to the agitator 5 in a wash step and to both the rotatable tub 4 and the agitator 5 in a dehydration step by the mechanical section 7.

Figure 2:
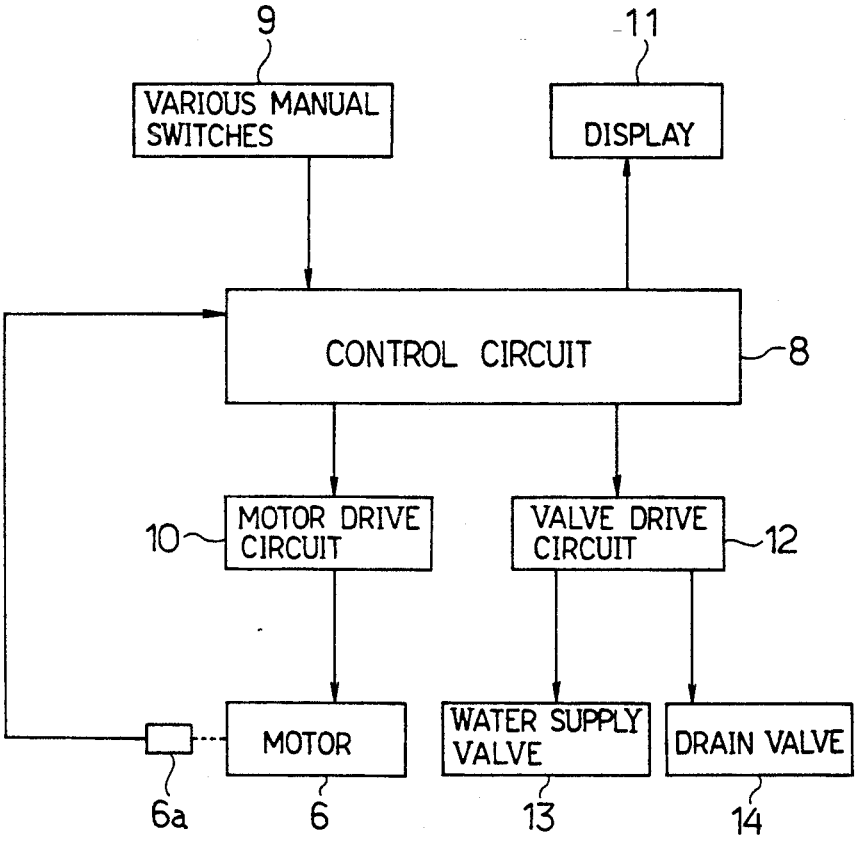
FIG. 2 is a block diagram of an electric circuit provided in the washing machine.

Referring now to FIG. 2, a microcomputer-based control circuit 8 includes an internal memory storing a control program for the wash and dehydration steps. The control circuit 8 controls a motor drive circuit 10 and a display 11 in accordance with the control program upon receipt of input from various manual switches 9 and further controls a water supply valve 13 and a drain valve 14 via a valve drive circuit 12. The manual switches 9 and the display 11 are disposed in an operation section (not shown) provided in the upper front side of the outer cabinet 1. The control circuit 8 and the motor drive circuit 10 are disposed in the upper rear side of the outer cabinet 1. The control circuit 8 is supplied with a position sensitive signal from a position sensitive element 6*a* provided in the motor 6, the position sensitive signal being representative of the rotational speed of the motor 6. Based on the position sensitive signal, the control circuit 8 delivers a control signal to the motor drive circuit 10 so that an armature coil of the motor 6 is energized at a proper energizing timing and that a voltage is applied to the armature coil so that the motor 6 reaches a necessary rotational speed. The motor drive circuit 10 varies the voltage applied to the motor 6 based on the control signal from the control circuit 8 so that the rotational speed of the motor 6 is controlled.

Figure 3:
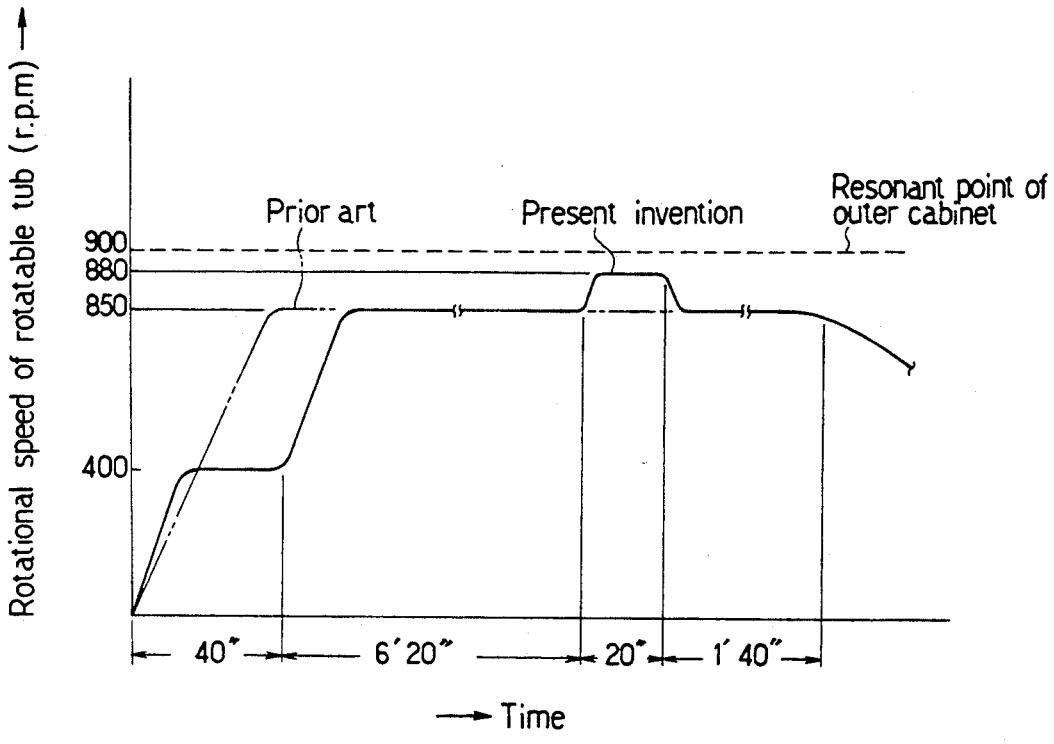
FIG. 3 is a graph showing changes in the rotational speed of the dehydration tub serving as the rotatable tub in a standard mode of the dehydrating operation.
Figure 5:
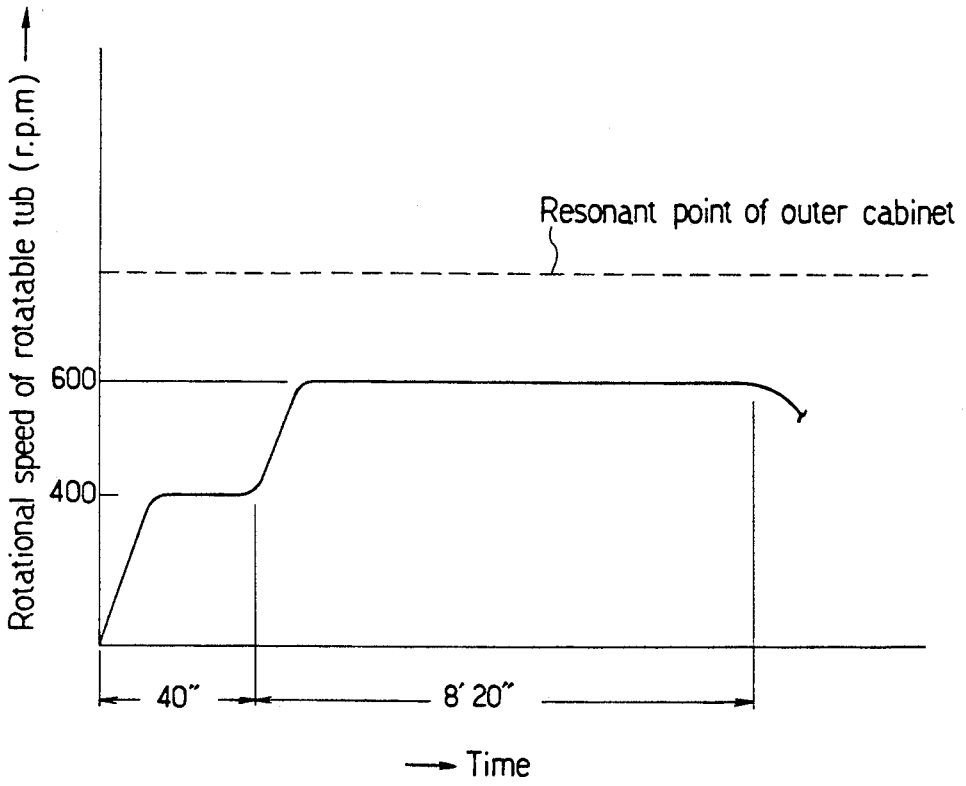
FIG. 5 is a graph showing changes in the rotational speed of the dehydration tub in a crease prevention mode of the dehydrating operation.

Either a standard dehydration mode or a crease preventive dehydration mode is selected with one of the manual switches 9 with respect to the dehydrating operation. When the standard dehydration mode is selected, the motor 6 is controlled so that the rotatable tub 4 is rotated at the speed of 400 r.p.m. for initial forty seconds of the dehydrating operation. Subsequently, the motor 6 is controlled in a rotational speed variation pattern that the rotatable tub 4 is rotated at the speed of 850 r.p.m. for six minutes and twenty seconds, at 880 r.p.m. for twenty seconds, and at 850 r.p.m. for one minute and forty seconds in turn. Thus, the rotational speed of the rotatable tub 4 is varied as shown by the solid line in FIG. 3 while the two-dot chain line in FIG. 3 shows a rotational speed curve of a rotatable tub of the conventional fully automatic washing machine. It is understood that the outer cabinet 1 resonates at the speed of 900 r.p.m. of the rotatable tub 4, producing a loud noise. Accordingly, the maximum speed of the rotatable tub 4 in the dehydrating operation is set to 880 r.p.m. which speed is higher than the rated rotational speed equal to the maximum speed of 850 r.p.m. in the conventional washing machine and lower than the resonant point of the outer cabinet 1 (900 r.p.m.).

Where the crease preventive dehydration mode is selected, the motor 6 is controlled so that the rotatable tub 4 is rotated at the speed of 400 r.p.m. for the initial forty seconds of the dehydrating operation. Subsequently, the rotatable tub 4 is rotated at the speed of 600 r.p.m. for eight minutes and twenty seconds. The rotational speed of the rotatable tub 4 is thus varied in the crease preventive dehydration mode as shown in FIG. 5.

As described above, the rotatable tub 4 is rotated at the lower speed of 400 r.p.m. for the initial forty seconds under control of the motor 6 when the standard dehydration mode is selected with one of the manual switches 9. Since a large amount of water is contained in the clothes at this initial stage of the dehydration step, a large amount of water is discharged out of the rotatable tub 4. However, the force of the water discharged out of the rotatable tub 4 is weak since the rotational speed of the rotatable tub 4 is relatively low at the initial stage. Consequently, a loud noise is not produced even when the discharged water collides with the inner peripheral wall of the water-receiving tub 3.

The rotatable tub 4 is sometimes rotated with a swinging motion when the clothes placed in it are unbalanced. In this case the rotational speed of the rotatable tub 4 is not smoothly increased. When the rotatable tub 4 is rotated at the speed of 200 r.p.m. or below continuously for twenty seconds, it is determined by the control circuit 8 that the clothes are unbalanced, interrupting the dehydrating operation to prevent a disadvantage that the dehydrating operation is completed with an insufficient dehydration due to the low speed rotation of the rotatable tub 4. A suitable amount of water may be added into the rotatable tub 4 to balance the clothes so that the dehydrating operation is restarted when it is determined that the clothes in the rotatable tub 4 is balanced.

When the period of rotation at the low speed of 400 r.p.m. elapses, the motor 6 is controlled so that the rotatable tub 4 is rotated at the rated speed of 850 r.p.m. and subsequently, at the speeds of 880 r.p.m. and 850 r.p.m. in turn in accordance with the speed control curb shown by the solid line in FIG. 3. A large centrifugal force acts on the water contained in the clothes as the rotational speed of the rotatable tub 4 is increased as described above, resulting in discharge of the water out of the rotatable tub 4. However, since a large amount of water has already been discharged in the previous low speed rotation stage, an amount of water discharged out of the rotatable tub 4 per unit period is not so large that a loud noise is not produced even when the discharged water collides with the inner peripheral wall of the water-receiving tub 3. Further, since the maximum speed (880 r.p.m.) of the rotatable tub 4 is lower than the speed of 900 r.p.m. at which the outer cabinet 1 resonates, the outer cabinet 1 can be prevented from vibrating to thereby produce a loud noise.

Figure 4:
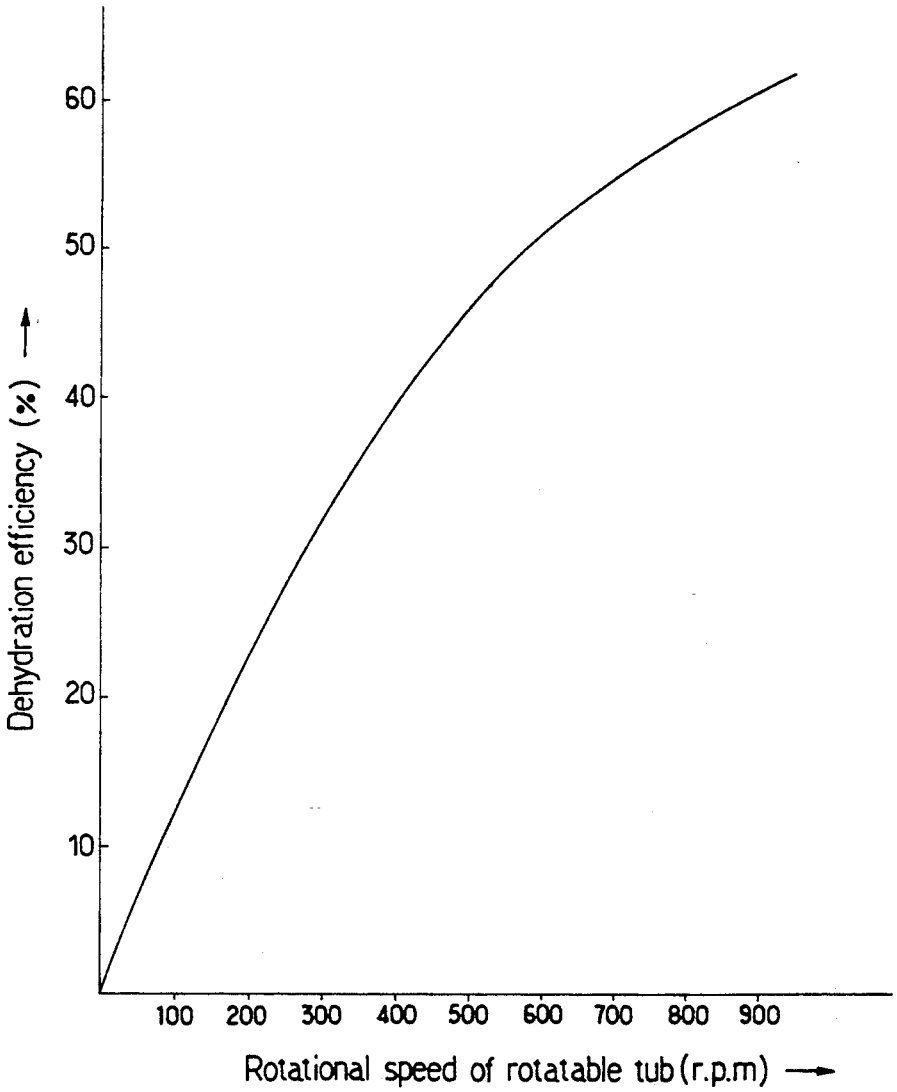
FIG. 4 is a graph showing a dehydration efficiency rotatable tub rotational speed characteristic.

Further, since the maximum speed of the rotatable tub 4 is set to be higher than the rated speed of 850 r.p.m., a high dehydration efficiency can be achieved. FIG. 4 shows a dehydration efficiency curb with respect to the rotational speed of the rotatable tub 4. As obvious, it can be understood that the dehydration efficiency can be improved in the dehydrating manner of the present invention wherein the maximum rotational speed of the rotatable tub 4 is at 880 r.p.m., as compared with the prior art wherein the maximum rotational speed of the rotatable tub is at 850 r.p.m. or the rated speed.

Additionally, the period of rotation of the rotatable tub 4 at the maximum speed of 880 r.p.m. is a relatively short period of twenty seconds and not over the whole period of the dehydrating operation. Consequently, a sufficient strength of the rotatable tub 4 against its rotational speed can be secured. As a matter of course, the strength of the rotatable tub 4 may be increased so that the period of rotation at 880 r.p.m. is lengthened, for example, it may be rotated at 880 r.p.m. over the whole dehydration period except for the low speed (400 r.p.m.) rotation period.

On the other hand, when the crease preventive dehydration mode is selected, the motor 6 is controlled so that the rotatable tub 4 is rotated at the speed of 400 r.p.m. for the initial forty seconds. A large amount of water contained in the clothes is also discharged out of the rotatable tub 4 in this stage. However, a loud noise is not produced even when the discharged water collides with the inner peripheral wall of the water-receiving tub 3, for the same reason as described above in relation to the standard dehydration mode. Further, when the rotatable tub 4 is rotated at 200 r.p.m. or below continuously for twenty seconds, the dehydrating operation is interrupted in the same manner as described above. The rotational speed of the rotatable tub 4 is increased to 600 r.p.m. after rotation at 400 r.p.m. The rotatable tub 4 is maintained at 600 r.p.m. for eight minutes and twenty seconds and subsequently, the dehydrating operation is completed. In the above-described crease preventive dehydration mode, the degree that the clothes are pressed against the inner peripheral wall of the rotatable tub 4 is relatively low, thus preventing the clothes from being creased.

The foregoing disclosure and drawings are merely illustrative of the principles of the present invention and are not to be interpreted in a limiting sense. The only limitation is to be determined from the scope of the appended claims.

We claim:

1. A dehydrator comprising:

a) a dehydration tub mounted in an outer cabinet;

b) a motor arranged for rotating the dehydration tub for a dehydrating operation; and c) control means for controlling the rotational speed of the motor so that the motor is rotated at a plurality of different rotational speeds for respective discrete intervals sequentially during the dehydrating operation, the different rotational speeds including a rated rotational speed and a maximum rotational speed ranging above the rated rotational speed and below a rotational speed corresponding to a resonant point of the outer cabinet.

2. A dehydrator according to claim 1, wherein the motor is controlled by the control means so that rotation of the dehydration tub is held at the rated rotational speed for a predetermined period of time and subsequently, the dehydration tub is rotated at the maximum rotational speed for a period of time shorter than the period of time during which the dehydration tub is held at the rated rotational speed.

3. A dehydrator according to claim 1, wherein the motor is controlled by the control means so that the dehydration tub is rotated in a rotational speed variation pattern wherein the dehydration tub is rotated at the rated rotational speed both before and after rotation of the dehydration tub at the maximum rotational speed.

4. A dehydrator according to claim 1, wherein the motor is controlled by the control means so that the dehydration tub is rotated in a rotational speed variation pattern wherein the dehydration tub is rotated at the rated rotational speed after the dehydration tub is held at a predetermined low rotational speed lower than the rated rotational speed for a predetermined period of time at an initial stage of the dehydrating operation.

5. A dehydrator according to claim 1, wherein the motor includes a dc brushless motor.

6. A dehydrator comprising:

a) a dehydration tub mounted in an outer cabinet;

b) a motor arranged for rotating the dehydration tub for a dehydrating operation; and c) control means for controlling the rotational speed of the motor so that the motor is rotated at a plurality of different rotational speeds for respective discrete intervals sequentially during the dehydrating operation, the different rotational speeds including a maximum rotational speed which is above the rated rotational speed and below a rotational speed corresponding to a resonant point of the outer cabinet.

7. A dehydrator according to claim 6, wherein the motor is controlled by the control means so that rotation of the dehydration tub is held at the rated rotational speed for a predetermined period of time and subsequently, the dehydration tub is rotated at the maximum rotational speed for a period of time shorter than the period of time during which the dehydration tub is held at the rated rotational speed.

* * * * *